US007595715B2

(12) United States Patent
Pavlovic et al.

(10) Patent No.: US 7,595,715 B2
(45) Date of Patent: Sep. 29, 2009

(54) HIGH POWER CASE FUSE

(75) Inventors: Slobadan Pavlovic, Canton, MI (US); Mohamad Zeidan, Dearborn Heights, MI (US); David Menzies, Linden, MI (US)

(73) Assignee: Lear Corporation, Southfield, MI (US)

( * ) Notice: Subject to any disclaimer, the term of this patent is extended or adjusted under 35 U.S.C. 154(b) by 193 days.

(21) Appl. No.: 11/862,314

(22) Filed: Sep. 27, 2007

(65) Prior Publication Data

US 2009/0085712 A1 Apr. 2, 2009

(51) Int. Cl.
*H01H 85/153* (2006.01)
*H01H 85/143* (2006.01)

(52) U.S. Cl. ..... 337/198; 337/195; 337/187; 337/251; 439/250; 439/849; 439/850; 439/890

(58) Field of Classification Search ..... 337/195, 337/198, 251, 187, 188; 439/839, 851, 849, 439/850, 843, 845, 852, 250, 890; D13/161, D13/178
See application file for complete search history.

(56) References Cited

U.S. PATENT DOCUMENTS 2,774,951 A * 12/1956 Hammell et al. ..... 439/849
2,921,287 A * 1/1960 Anderson et al. ..... 439/849
3,550,069 A * 12/1970 Teagno et al. ..... 439/849
4,553,808 A * 11/1985 Weidler et al. ..... 439/391
4,570,147 A * 2/1986 Ebi ..... 337/166
4,646,052 A * 2/1987 Matsunaga et al. ..... 337/166
4,672,352 A * 6/1987 Takano ..... 337/264
4,751,490 A * 6/1988 Hatagishi ..... 337/295
4,869,972 A * 9/1989 Hatagishi ..... 428/647
4,871,990 A * 10/1989 Ikeda et al. ..... 337/238
4,958,426 A * 9/1990 Endo et al. ..... 29/623
5,147,230 A * 9/1992 Plyler et al. ..... 439/843
5,226,842 A * 7/1993 Endo et al. ..... 439/843
5,350,321 A * 9/1994 Takenouchi ..... 439/839
5,416,461 A * 5/1995 Totsuka et al. ..... 337/261
5,427,552 A * 6/1995 Zielinski et al. ..... 439/845
5,488,346 A * 1/1996 Kondo et al. ..... 337/198
5,581,225 A * 12/1996 Oh et al. ..... 337/295
5,658,174 A * 8/1997 Benes et al. ..... 439/843
5,679,034 A * 10/1997 Hanazaki et al. ..... 439/845
5,716,245 A * 2/1998 Kameyama et al. ..... 439/852
5,745,024 A * 4/1998 Ohta et al. ..... 337/166

(Continued)

FOREIGN PATENT DOCUMENTS

JP 09147731 A * 6/1997

*Primary Examiner*—Anatoly Vortman
(74) *Attorney, Agent, or Firm*—MacMillan, Sobanski & Todd, LLC

(57) ABSTRACT

A high power fuse includes a fuse body having a first terminal receptor including a first set of terminal legs and a second terminal receptor in spaced relation to the first terminal receptor. The second terminal receptor includes a second set of terminal legs. A fuse element is disposed between the first terminal receptor and the second terminal receptor. A first clamp-like member is mounted to the fuse body for applying a predetermined compression force against the first set of terminal legs and is configured to secure a first male terminal between the first set of terminal legs. A second clamp-like member is mounted to the fuse body for applying a predetermined compression force against the second set of terminal legs and is configured to secure a second male terminal between the second set of terminal legs.

20 Claims, 3 Drawing Sheets

U.S. PATENT DOCUMENTS 5,781,094 A * 7/1998 Nakamura et al. ..... 337/238
5,818,321 A * 10/1998 Muramatsu et al. ..... 337/198
5,883,561 A * 3/1999 Nakamura et al. ..... 337/198
5,929,740 A * 7/1999 Oh et al. ..... 337/198
6,011,454 A 1/2000 Huang et al.
6,042,433 A * 3/2000 Chen ..... 439/852
6,062,918 A * 5/2000 Myer et al. ..... 439/839
6,144,283 A * 11/2000 Matsumura ..... 337/198
6,529,113 B2 * 3/2003 Endo et al. ..... 337/198
6,547,608 B2 * 4/2003 Sato et al. ..... 439/852
6,570,306 B2 5/2003 Henrici et al.
6,828,896 B2 * 12/2004 Ohashi et al. ..... 337/205
7,086,912 B2 8/2006 Matsuura et al.
2001/0043139 A1 * 11/2001 Endo et al. ..... 337/238

* cited by examiner

HIGH POWER CASE FUSE

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A SEQUENCE LISTING, A TABLE, OR A COMPUTER PROGRAM LISTING COMPACT DISC APPENDIX

Not Applicable

BACKGROUND OF THE INVENTION

1. Field of Invention

This invention relates in general to fuses, and in particular to high power case fuses.

2. Background of Related Art

High power distribution box fuse assemblies used in vehicles commonly include a nonconductive housing encasing a conductive set of female terminals (i.e., fuse body). The set of female terminals are joined by a fuse element disposed therebetween. The female terminals are inserted over a set of male blade terminals extending from the power distribution box for completing an electrical circuit. The female terminals are typically designed with a spring-type feature to maintain a strong electrical contact with the male terminal blades. If the current draw of the electrical circuit increases above a predetermined current threshold, the fuse element will open thereby terminating current flow across the respective set of female terminals.

Copper which is has good electrical conductivity properties is preferably used to produce the fuse body; however, copper is susceptible to relaxation as temperature increases. That is, as the current drawn in the electrical circuit increases, so does the temperature. In response to the temperature increase, copper has a tendency to relax. As a result, the clamping portion of the fuse body for maintaining a tight connection with the male terminal blades (e.g., the spring-type future of the female terminals) relaxes thereby decreasing the overall contact area which reduces electrical conductivity (i.e., increases resistance).

Since the fuse body is encased within the housing, the thickness of the female terminals (i.e., the springs) is limited to a predetermined size due to packaging constraints. As a result, the footprint of the fuse body is limited such that additional material is prevented from being added to strengthen the spring-like features for maintaining contact with the male terminal blades. As a result, copper alloy having lower conductivity properties is typically substituted for the copper-based material having higher conductivity properties to produce the fuse body. The relaxation properties for copper alloy having low conductivity properties occur at much higher temperatures as compared to copper. Therefore, a desired contact area between the female terminals and the male terminal blades can be maintained at elevated temperatures using the copper alloy in comparison to copper-based material having higher conductivity properties. The disadvantage is that the copper alloy has lower conductivity properties in comparison to copper-based material. As a result, the fuse assembly, given the perspective footprint, are limited to 60 amps or less.

BRIEF SUMMARY OF THE INVENTION

The present invention has the advantage of providing a high power fuse assembly that maintains a predetermined normal force on a respective set of female terminals that resists relaxation such that a respective contact area is maintained at elevated temperatures using a separate spring/clamp-like member. The clamp-like member is produced from a material having high mechanical stress properties such as stainless steel. That is, the clamp-like member has greater mechanical stress properties at elevated temperatures in comparison to the material of the female terminals of the fuse. Utilizing a material with good stress relaxation properties at elevated temperatures for the clamp-like member allows for the use of high conductive materials for the female terminals. This assists in maintaining the respective contact area at elevated temperatures and allows more current to be carried through the fuse while maintaining a respective footprint of the fuse assembly within a plastic housing.

In one aspect of the present invention, a high power fuse includes a fuse body having a first terminal receptor including a first set of terminal legs and a second terminal receptor in spaced relation to the first terminal receptor. The second terminal receptor includes a second set of terminal legs. A fuse element is disposed between the first terminal receptor and the second terminal receptor. A first clamp-like member is mounted to the fuse body for applying a predetermined compression force against the first set of terminal legs and is configured to secure a first male terminal between the first set of terminal legs. A second clamp-like member is mounted to the fuse body for applying a predetermined compression force against the second set of terminal legs and is configured to secure a second male terminal between the second set of terminal legs.

In yet another aspect of the present invention, a high power fuse assembly is provided that includes a plastic housing and a fuse body housed in the plastic housing. The fuse body includes a first terminal receptor having a first set of terminal legs and a second terminal receptor having a second set of terminal legs. A fuse element is integrally formed to the first terminal receptor and the second terminal receptor. A first clamp-like member is disposed within the first terminal receptor. The first clamp-like member applies a compression force against the first set of terminal legs that is configured to secure a first male terminal within the first set of terminal legs. A second clamp-like member is disposed within the second terminal receptor. The second clamp-like member applies a compression force against the second set of terminal legs that is configured to secure a second male terminal within the first set of terminal legs.

Various objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
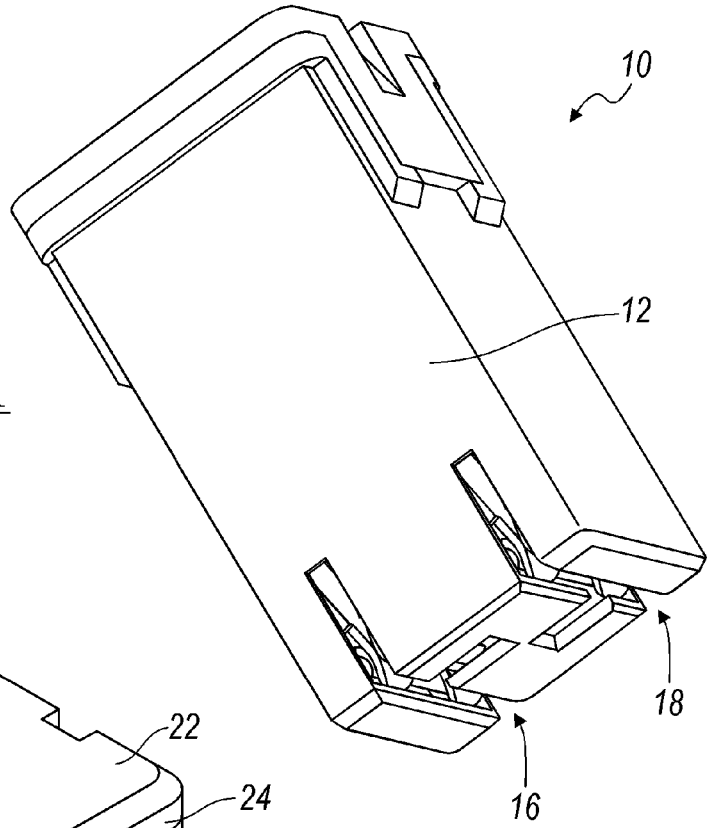
FIG. 1 is a perspective view of a fuse according to a first preferred embodiment of the present invention.

Referring now to the drawings, there is illustrated in FIG. 1 a high power fuse shown generally at 10. The high power fuse 10 includes a housing 12 and a fuse assembly 14 disposed within the housing 12. The housing 12 includes a first slot 16 for receiving a first terminal blade (not shown) and a second slot 18 for receiving a second terminal blade (not shown).

Figure 2:
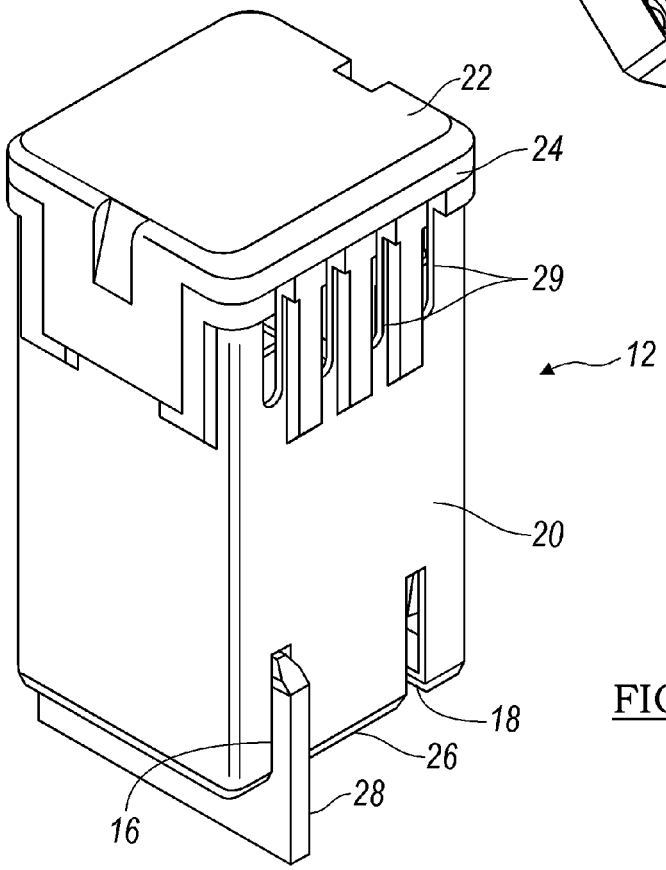
FIG. 2 is a perspective view of a fuse housing according to a first preferred embodiment of the present invention.

FIG. 2 illustrates a perspective view of the housing 12. The housing 12 is preferably produced from two sections that include a body portion 20 and a lid portion 22. The body portion 20 is an elongated chamber that includes an open end 24 and a closed end 26. The open end 24 is of a sufficient width and length for receiving and housing the fuse assembly 14 (shown in FIG. 3) within the housing 12. The first slot 16 and the second slot 18 are formed in the closed end 26. The slots are aligned with respective receiving members for making an electrical connection with a respective terminal blade (shown generally at 28).

The lid portion 22 attaches to the open end 24 for enclosing the fuse assembly 14 therein. The housing 12 isolates a person or other object from contacting with the fuse assembly 14 within the housing 12 which may otherwise result in an electrical shock to a person contacting the exposed fuse or a short circuit. The body portion 20 includes ventilation slots 29 formed near the closed end 26 of the body portion 20. As heat is generated by the fuse assembly 14 enclosed within the housing 12, the ventilation slots 29 formed near the top of the body portion 20 provide ventilation (e.g., a chimney effect) for dissipating the heat generated by the fuse assembly 14.

Figure 3:
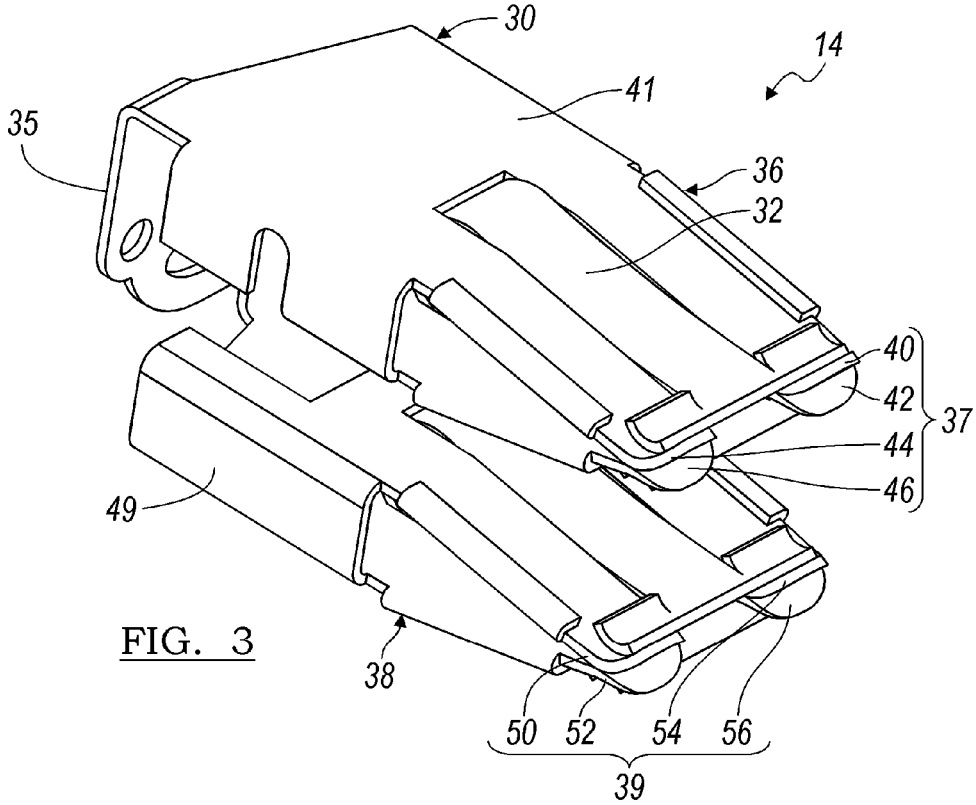
FIG. 3 is a perspective view of a fuse assembly according to a first preferred embodiment of the present invention.

FIG. 3 illustrates the fuse assembly 14. The fuse assembly 14 includes a fuse body 30, a first clamp-like member 32, and a second claim-like member 34. The fuse body 30 is preferably made from a single piece of stamped metal such as copper. The fuse body 30 includes a fuse element 35, a first terminal receptor 36, for receiving a respective male terminal blade (not shown), and a second terminal receptor 38 for receiving respective male terminal blade (not shown). The fuse element 35 is integrally formed between the first terminal receptor 36 and the second terminal receptor 38. The fuse element 35 is produced from the same material as the first terminal receptor 36 and the second terminal receptor 38. In addition, fuse element 35 is plated with a second material, such as tin, that when heated, diffuses into the copper which lowers the melting point of the copper. At a predetermined current draw (i.e., predetermined temperature), the tin begins to diffuse into the copper and the diffused portion of the copper begins to melt thereby creating an open circuit within the fuse element 35 for terminating current flow between the first terminal receptor 36 and the second terminal receptor 38.

Figure 4:
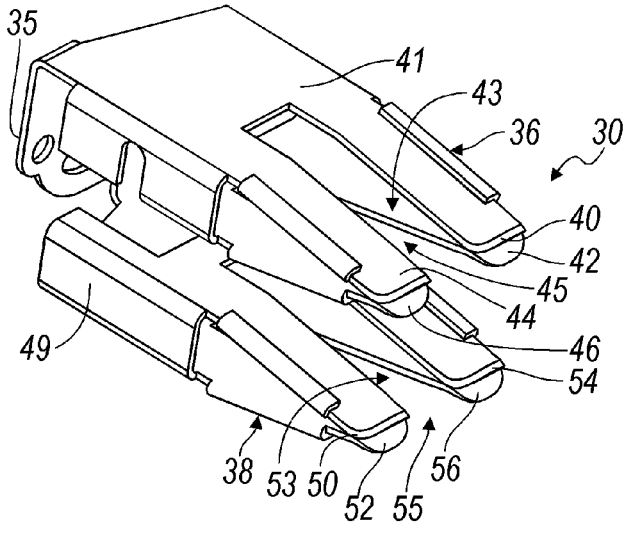
FIG. 4 is a perspective view of the fuse body according to a first preferred embodiment of the present invention.

FIG. 4 illustrates a fuse body 30 less the respective clamp-like members. The first terminal receptor 36 includes a body portion 41 having a first set of terminal legs 37 extending from the body portion 41. The body portion 41 is preferably a non-resilient section that conductively couples the fuse element 35 to the first set of terminal legs 37. The first set of terminal legs 37 includes a first leg 40 and a second leg 42 opposing one another. The first set of terminal legs 37 further includes a third leg 44 and a fourth leg 46 opposing one another and are also positioned adjacent to the first leg 40 and the second leg 42, respectively. The first leg 42 and the third leg 44 are in spaced relation to one another having a respective space 43 therebetween. The second leg 42 and the fourth leg 46 are in spaced relation to one another having a respective space 45 therebetween. Each of the respective legs are resilient for maintaining a compression force on a respective terminal blade received between the first and second legs 40 and 42 and the second and third legs 44 and 46.

The second terminal receptor 38 includes a body portion 49 having a second set of terminals legs 39 extending from the body portion 49. The second set of terminal legs 39 includes a first leg 50 and a second leg 52 opposing one another. The second set of terminal legs 38 further includes a third leg 54 and a fourth leg 56 opposing one another and are positioned adjacent to the first leg 50 and the second leg 52. The first leg 50 and the third leg 54 are in spaced relation to one another having a respective space 53 therebetween. The second leg 52 and the fourth leg 56 are in spaced relation to one another having a respective space 55 therebetween. Each of the respective legs are resilient for maintaining a compression force on a respective terminal blade received between the first and second legs 50 and 52 and the second and third legs 54 and 56.

Referring again to FIG. 3, the first clamp-like member 32 is assembled to the fuse body 30 for applying a predetermined compression force against the first set of terminal legs 36. The first clamp-like member 32 is mounted to the first terminal receptor 36 centrally located between the first set of terminal legs 37 within the respective spaces 43 and 45. The first clamp-like member 32 is configured to secure a respective terminal blade between the first set of terminal legs 36 for maintaining a respective contact area during elevated temperatures.

Figure 5:
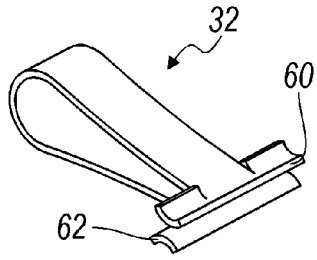
FIG. 5 is a perspective view of a clamp-like member according to a first preferred embodiment of the present invention.

FIG. 5 illustrates the clamp-like members 32 and 34. The first clamp-like member 32 is a substantially U-shaped body having a first end portion 60 and a second end portion 62. The first end portion 60 and the second end portion 62 are arc-shaped. The first end portion 60 and the second end portion 62 extend toward one another as the respective legs of the U-shaped body extend away from the curved end adjoining the respective legs.

Referring again to FIG. 3, when the first clamp-like member 32 is mounted to the first set of terminal legs 37, the first end portion 60 contacts an exterior section of the first leg member 40 and third leg member 44. In addition, the second end portion 62 of the first clamp-like member 32 contacts an exterior section of the second leg member 42 and the fourth leg member 46 thereby holding the first and third leg members 40 and 44 in compression with second and fourth leg members 42 and 46, respectively. The first leg member 40 and the third leg member 44 have respective end sections for nesting the first end portion 60 of the first clamp-like member 32 for preventing sliding movement between the first and third leg members 40 and 44 and the first end portion 60. This provides a seating engagement between first and third leg members 40 and 44 and the first end portion 60. Similarly, the second leg member 42 and the fourth leg member 46 have respective end sections for nesting the second end portion 62 of the second clamp-like member 34 for preventing sliding movement between the second and fourth leg members 42 and 46 and the second end portion. This provides a seating engagement between second and fourth leg members 42 and 46 and the second end portion 62.

The first clamp-like member 32 is made of stainless steel which has low relaxation properties at elevated temperatures. As a result, the first clamp-like member 32 prevents the respective terminal legs from relaxing at elevated temperatures for preventing the reduction of the contact area with an associated blade terminal. As a result, the need for utilizing a copper alloy or similar substitute of material with lesser conductive properties is not necessary since relaxation has been minimized. Therefore a higher conductive material, such as copper (C151), for forming the fuse body 30 may be used in cooperation with the first clamp-like member 32.

Similarly, the second clamp-like member 34 is mounted on the fuse body 30 for applying a predetermined compression force against the second set of terminal legs 38. The second clamp-like member 34 is configured to secure a respective terminal blade between the first set of terminal legs 38 for maintaining a respective contact area during elevated temperature increases. The second clamp-like member 34 is mounted to the second terminal receptor 38 centrally located between the second set of terminal legs 38 within the respective spaces 43 and 45.

A first end portion of the second clamp-like member 34 contacts an exterior portion of the first leg member 50 and third leg member 54. In addition, a second end portion of the second clamp-like member 34 contacts an exterior portion of the second leg member 52 and fourth leg member 56 thereby holding the first and third leg member 50 and 54 in compression with second and fourth leg member 52 and 56, respectively.

The first leg member 50 and the third leg member 54 have respective end sections for nesting the first end portion of the second clamp-like member 34 for preventing sliding movement between the first and third leg members 50 and 54 and the first end portion. This provides a seating engagement between first and third leg members 50 and 54 and the first end portion of the second clamp-like member 34. Similarly, the second leg member 52 and the fourth leg member 56 have respective end sections for nesting the second end portion of the second clamp-like member 34 for preventing sliding movement between the second and fourth leg members 52 and 56 and the second end portion. This provides a seating engagement between second and fourth leg members 52 and 56 and the second end portion of the second clamp-like member 34.

The second clamp-like member 34 is made of stainless steel which has low relaxation properties at elevated temperatures. As a result, the second clamp-like member 34 prevents the respective terminal legs from relaxing which could otherwise reduce the contact area with an associated blade terminal. Alternatively, the first and second clamp-like members 32 and 34 may be made of a material other than stainless steel so long as material has less relaxation at elevated temperatures in comparison to the material forming the fuse body 30.

The contact area of the electrical coupling of the respective leg members and the respective blade terminals is maintained during elevated temperatures as a result of the normal force applied by the first and second clamp-like member. This results in increased resistance between the mating terminals which further results in increased conductivity at the respective electrical coupling. As described earlier, high power fuses are typically limited to 60 amps maximum due conductive properties of the copper alloy which is used to prevent relaxation at elevated temperatures. The use of the clamp-like members as described in the present invention allows the fuse body to be made of a copper-based material having higher conductive properties than copper alloy which provide for increased current rating usage at elevated temperatures. For example, a respective fuse body made from substantially 0.4 mm of copper stock for a respective footprint could handle up to 80 amps. A respective fuse body made from substantially 0.6 mm of copper stock fitting using the same respective footprint could handle up to 100 amps.

Figure 6:
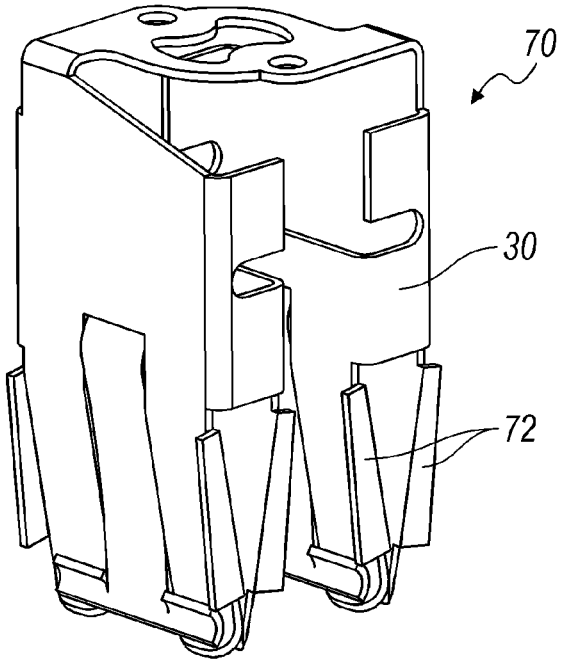
FIG. 6 is a perspective view of a fuse assembly according to a second preferred embodiment of the present invention.

FIG. 6 illustrates a high power fuse assembly according to a second preferred embodiment. The fuse assembly 70 includes a plurality of heat sinks 72 for dissipating heat within the fuse body 30. The plurality of heat sinks 72 includes a plurality of fins integrally formed as part of the respective leg members of the fuse body 30. The plurality of fins is positioned so as to allow air to pass over the plurality of fins thereby dissipating heat from the fuse body 30.

Figure 7:
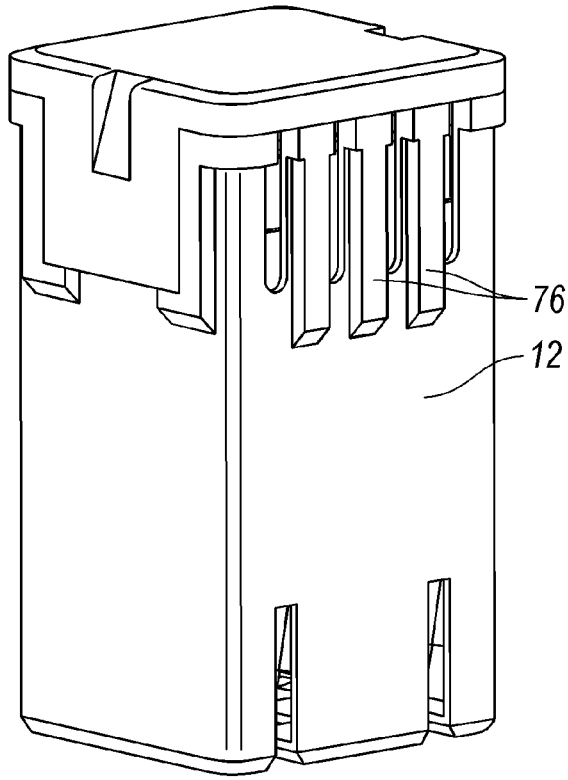
FIG. 7 is a perspective view of a fuse housing according to a third preferred embodiment of the present invention.

FIG. 7 illustrates a housing 12 according to a third preferred embodiment. The housing 12 may be made of a plastic polymer that is thermally conductive. A plurality of cooling fins 76 may be formed an the exterior surface of the housing 12 such that heat thermally conducted through the plastic material is dissipated by the air as it flows over plurality of cooling fins 76.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A high power fuse comprising:

a fuse body comprising:

a first terminal receptor including a first set of terminal legs;

a second terminal receptor in spaced relation to the first terminal receptor, the second terminal receptor including a second set of terminal legs; and a fuse element integrally disposed between the first terminal receptor and the second terminal receptor;

a first clamp-like member mounted to the fuse body for applying a predetermined compression force against the first set of terminal legs that is configured to secure a first male terminal between the first set of terminal legs; and a second clamp-like member mounted to the fuse body for applying a predetermined compression force against the second set of terminal legs that is configured to secure a second male terminal between the second set of terminal legs.

2. The high power fuse of claim 1 wherein the first clamp-like member is disposed within the first terminal receptor centrally between the first set of terminal legs.

3. The high power fuse of claim 2 wherein the first set of terminal legs include a first leg and a second leg opposing one another and a third leg and a fourth leg opposing one another, the first and third leg being in spaced relation to one another and the second and fourth leg being in spaced relation to one another, the first clamp-like member being disposed in the spaces between the first and third legs and the second and fourth legs.

4. The high power fuse of claim 1 wherein the second clamp-like member is disposed within the second terminal receptor centrally between the second set of terminal legs.

5. The high power fuse of claim 4 wherein the second set of terminal legs include a first leg and a second leg opposing one another and a third leg and a fourth leg opposing one another, the first and third leg being in spaced relation to one another and the second and fourth leg being in spaced relation to one another, the second clamp-like member being disposed in the spaces between the first and third legs and the second and fourth legs.

6. The high power fuse of claim 1 wherein the first and second clamp-like members are substantially U-shaped having respective end portions, wherein the respective end portions of the first clamp-like member extend toward one another, and wherein the respective end portions of the second clamp-like member extend toward one another.

7. The high power fuse of claim 6 wherein the respective end portions of the first clamp-like member exert a compression force against the first set of terminal legs and second clamp-like member exert a compression force against the second set of terminal legs for applying a normal force against a respective first male terminal and a respective second male terminal inserted between the first and second set of terminal legs, respectively.

8. The high power fuse of claim 7 wherein the end portions of the first and second clamp-like members are nested in respective end sections of the first and second set of terminal legs for preventing sliding movement between the end portions of the first and second clamp-like members and the respective end sections of the first and second set of terminal legs.

9. The high power fuse of claim 7 wherein a material forming the first and second clamp-like members has less relaxation at elevated temperatures than a material forming the first and second set of terminal legs.

10. The high power fuse of claim 7 wherein the substantially U-shaped first and second clamp-like members each include a closed end, and wherein the respective first male terminal and second male terminal received between the first set of terminal legs and second set of terminal legs, respectively, extend toward the closed ends within the first and second clamp-like members.

11. The high power fuse of claim 1 wherein a first mating section of the first set of terminal legs that contacts the first male terminal and a second mating section of the second set of terminal legs that contacts the second male terminal provide normal forces to the first and second mating sections for preventing stress relaxation during increased temperature overloads.

12. The high power fuse of claim 1 wherein a material thickness of the fuse element provides a current rating greater than about 70 amps.

13. The high power fuse of claim 1 wherein the fuse body includes cooling fins for enhancing heat dissipation.

14. A high power fuse assembly comprising:

a plastic housing;

a fuse body housed in the plastic housing, the fuse body including a first terminal receptor having a first set of terminal legs, a second terminal receptor having a second set of terminal legs, a fuse element integrally formed to the first terminal receptor and the second terminal receptor;

a first clamp-like member disposed within the first terminal receptor, the first clamp-like member applying a compression force against the first set of terminal legs that is configured to secure a first male terminal within the first set of terminal legs; and a second clamp-like member disposed within the second terminal receptor, the second clamp-like member applying a compression force against the second set of terminal legs that is configured to secure a second male terminal within the first set of terminal legs.

15. The high power fuse assembly of claim 14 wherein the first and second clamp-like members are substantially U-shaped having respective end portions that extend toward one another, the respective end portions of the first and second clamp-like members exert a compression force against first set of terminal legs and the second set of terminal legs, respectively, for applying a normal force against a respective first male terminal and a second male terminal inserted between the first and second set of terminal legs, respectively.

16. The high power fuse assembly of claim 14 wherein a material forming the first and second clamp-like members has less relaxation at elevated temperatures than a material forming the first and second set of terminal legs.

17. The high power fuse assembly of claim 14 wherein a material thickness of the fuse body and integrally formed fuse element provides a current rating greater than about 70 amps.

18. The high power fuse assembly of claim 14 wherein the plastic housing includes ventilation openings configured to provide air convection ventilation.

19. The high power fuse assembly of claim 14 wherein the plastic housing comprises cooling fins for enhancing heat dissipation.

20. The high power fuse of claim 19 wherein the plastic housing comprises a heat conductive plastic.

* * * * *